US010150014B2

(12) United States Patent
Warren

(10) Patent No.: US 10,150,014 B2
(45) Date of Patent: Dec. 11, 2018

(54) RECREATIONAL DEVICE WITH ROTOR ASSEMBLY

(71) Applicant: William J. Warren, Frisco, TX (US)

(72) Inventor: William J. Warren, Frisco, TX (US)

( * ) Notice: Subject to any disclaimer, the term of this patent is extended or adjusted under 35 U.S.C. 154(b) by 0 days.

(21) Appl. No.: 15/487,394

(22) Filed: Apr. 13, 2017

(65) Prior Publication Data

US 2018/0161637 A1 Jun. 14, 2018

Related U.S. Application Data

(60) Provisional application No. 62/433,362, filed on Dec. 13, 2016, provisional application No. 62/433,136, filed on Dec. 12, 2016.

(51) Int. Cl.
*A63B 43/00* (2006.01)

(52) U.S. Cl.
CPC ..... *A63B 43/002* (2013.01); *A63B 2043/001* (2013.01); *A63B 2243/007* (2013.01)

(58) Field of Classification Search
CPC ..... A63B 43/002; A63B 2243/007; A63B 2043/001
See application file for complete search history.

(56) References Cited

U.S. PATENT DOCUMENTS 3,256,020 A * 6/1966 Smith ..... A63B 43/002 446/225
3,884,466 A * 5/1975 MacDonald ..... A63B 43/002 273/DIG. 20
4,923,196 A * 5/1990 Rohring ..... A63B 43/00 273/DIG. 20
5,269,514 A * 12/1993 Adler ..... A63B 43/002 273/DIG. 20
5,284,341 A * 2/1994 Routzong ..... A63B 43/00 273/DIG. 20
5,458,329 A * 10/1995 Bushman ..... A63B 43/002 273/DIG. 8
5,779,576 A * 7/1998 Smith, III ..... A63B 65/00 473/570
5,807,198 A * 9/1998 Grimm ..... A63B 65/00 473/613
6,010,419 A * 1/2000 Rappaport ..... A63B 43/002 473/613
6,042,494 A * 3/2000 Rappaport ..... A63B 43/002 473/613
6,695,728 B1 * 2/2004 Eddins ..... A63B 43/002 473/613
7,288,037 B2 * 10/2007 Myers ..... A63B 43/06 473/570
8,777,785 B2 * 7/2014 Martino ..... A63H 27/00 473/570

(Continued)

*Primary Examiner* — Steven Wong
(74) *Attorney, Agent, or Firm* — Carr & Ferrell LLP

(57) ABSTRACT

Recreational footballs with rotor assemblies are provided herein. An example football includes a plurality of struts forming a prolate spheroid frame; and one or more rotor assemblies each having a plurality of blades, the one or more rotor assemblies being disposed within the prolate spheroid frame, the one or more rotor assemblies changing at least one aerodynamic aspect of flight of the recreational device when air passes through the prolate spheroid frame and rotates the plurality of blades of the one or more rotor assemblies.

22 Claims, 8 Drawing Sheets

(56) References Cited

U.S. PATENT DOCUMENTS

| | | | | |
|---|---|---|---|---|
| 8,920,267 | B2 * | 12/2014 | Gable | A63H 33/185 446/34 |
| 9,782,636 | B2 * | 10/2017 | Martino | A63B 43/002 |
| 2001/0039221 | A1 * | 11/2001 | Schneider | A63B 41/00 473/614 |
| 2003/0027672 | A1 * | 2/2003 | Leal | A63B 43/00 473/613 |
| 2003/0100391 | A1 * | 5/2003 | Kessler | A63B 43/002 473/613 |
| 2008/0039246 | A1 * | 2/2008 | Martino | A63B 43/00 473/569 |
| 2008/0039250 | A1 * | 2/2008 | Martino | A63B 43/00 473/613 |
| 2011/0009218 | A1 * | 1/2011 | Wallach | A63B 43/002 473/594 |
| 2014/0235380 | A1 * | 8/2014 | Martino | A63H 27/14 473/613 |
| 2016/0067556 | A1 * | 3/2016 | Martino | A63B 43/002 473/613 |

* cited by examiner

RECREATIONAL DEVICE WITH ROTOR ASSEMBLY

CROSS-REFERENCE TO RELATED APPLICATIONS

The present application claims the benefit of U.S. Provisional Application No. 62/433,136, filed on Dec. 12, 2016, and of U.S. Provisional Application No. 62/433,362, filed on Dec. 13, 2016, all of which are hereby incorporated by reference for all purposes, including all references and appendices cited therein.

FIELD OF TECHNOLOGY

Embodiments of the present disclosure are directed to recreational devices, and more particularly, to recreational devices that resemble a football having an approximate prolate spheroid shape. The football can include one or more rotor assemblies that alter aerodynamic attributes of the football during flight.

SUMMARY

According to some embodiments, the present disclosure is directed to a recreational device, comprising: (a) a plurality of struts forming a prolate spheroid frame; and (b) one or more rotor assemblies each having a plurality of blades, the one or more rotor assemblies being disposed within the prolate spheroid frame, the one or more rotor assemblies changing at least one aerodynamic aspect of flight of the recreational device when air passes through the prolate spheroid frame and across the plurality of blades of the one or more rotor assemblies as the recreational device spirals during flight.

According to some embodiments, the present disclosure is directed to a football, comprising: (a) a plurality of struts forming a frame, the frame having open ends that allow air to pass into and out of the frame through the open ends; and (b) one or more rotor assemblies each having: (i) a drum; and (ii) a plurality of blades that are rotatably supported within the drum, (c) the one or more rotor assemblies being disposed within the frame, the plurality of blades of the one or more rotor assemblies rotating when the football is thrown through the air.

According to some embodiments, the present disclosure is directed to a recreational device, comprising: (a) a plurality of struts forming a prolate spheroid frame having at least one open end; (b) a plurality of radially arranged blades; and (c) means for rotatably supporting the plurality of radially arranged blades within the prolate spheroid frame in such a way that the plurality of radially arranged blades freely rotate within the prolate spheroid frame.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DESCRIPTION OF EXEMPLARY EMBODIMENTS

Embodiments of the present disclosure are directed to recreational devices, and more particularly but not by way of limitation, to recreational devices that resemble a football having an approximate prolate spheroid shape. While a prolate spheroid shape is contemplated, the recreational devices of the present disclosure can comprise any number of shapes as desired, such as cylindrical, ellipsoidal, and triangular (e.g., diamond shaped)—just to name a few.

Footballs of the present disclosure include one or more internal rotor assemblies that alter aerodynamic attributes of the football during flight. For example, the rotor assemblies can act as a turbine that increases and/or decreases a distance traveled by the football when thrown compared to a similar football without the one or more rotor assemblies disposed therein.

In some embodiments, the blades of the rotor assemblies are fixed. Air passes over the blades as the football spirals during flight. The passage of air over the blades will enhance a distance the football travels and spirals.

In various embodiments, the blades of the rotor assemblies rotate freely rather than being fixed. The rotor assemblies in these embodiments comprise a drum that mounts to one or more frame members that define the shape of the football. A plurality of radially arranged blades are disposed within the drum, similar to the configuration of a turbine. The radially arranged blades freely rotate clockwise or counterclockwise within the drum based on their respective left-handedness or right-handedness.

The frames of the footballs of the present disclosure comprise open inlet and outlet ends that allow air to pass through the frame and rotate the blades of the one or more internal rotor assemblies. In some embodiments, the open inlet end and open outlet end of the football are defined by an inlet rotor assembly and an outlet rotor assembly. One or more additional rotor assemblies can be disposed between the inlet rotor assembly and the outlet rotor assembly along a length of the frame.

These and other advantages of recreational devices of the present disclosure are described in greater detail herein with respect to the collective drawings.

Figure 1:
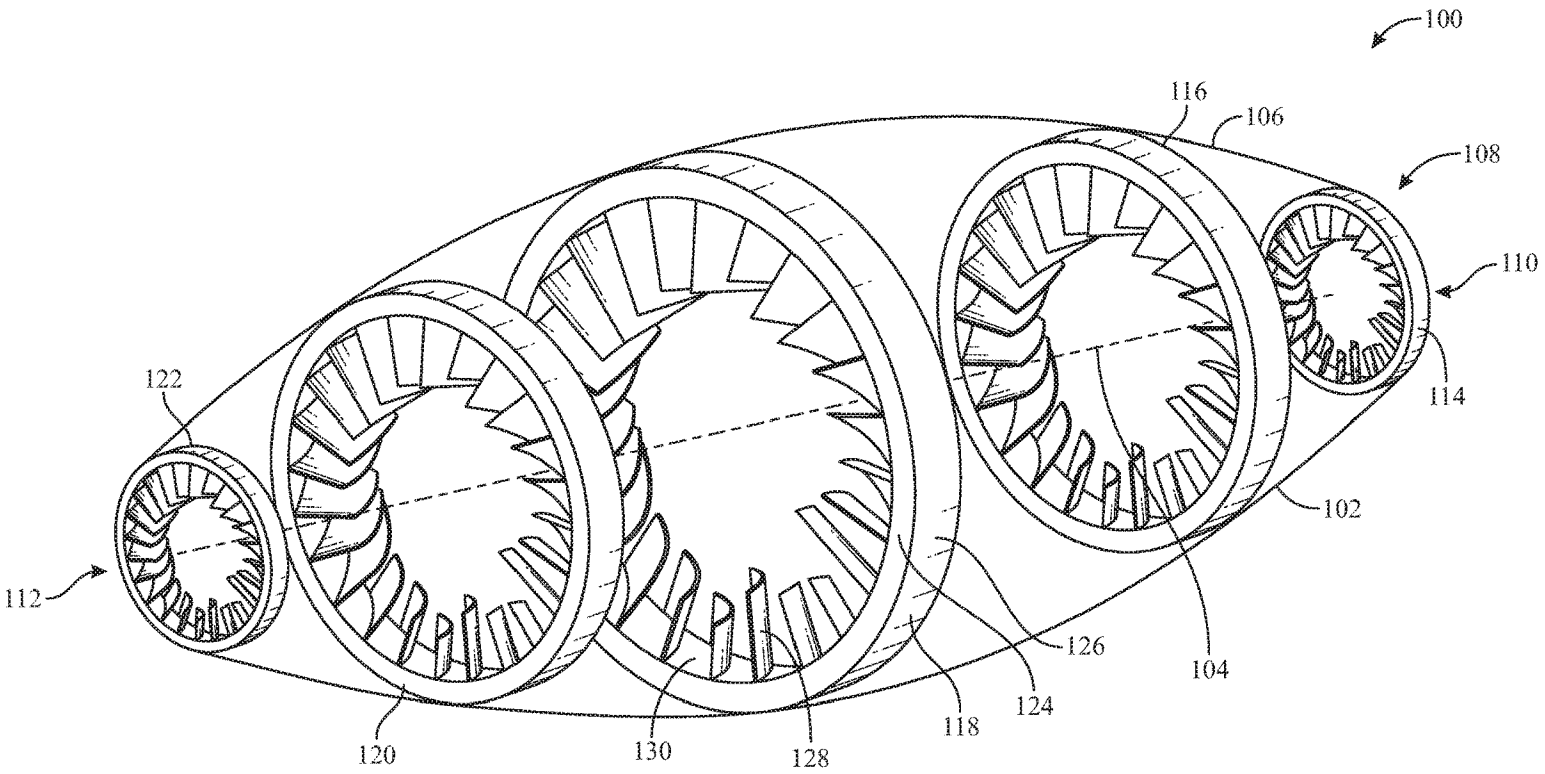
FIG. 1 is a perspective view of an example recreational device (e.g., a football), constructed in accordance with the present disclosure.

FIG. 1 illustrates an example recreational device (referred to hereinafter as "football 100"). The football 100 comprises a plurality of struts such as struts 102, 104, and 106 that collectively form a prolate spheroid frame 108. The struts 102, 104, and 106 can be manufactured from any suitable material such as a plastic, polymer, aluminum, carbon fiber, or any other suitable material or combination of materials. The struts 102, 104, and 106 form two ends of the football 100 that include an inlet end 110 and an outlet end 112.

In some embodiments, the football 100 comprises a plurality of rotor assemblies such as rotor assemblies 114, 116, 118, 120, and 122. The first, or inlet rotor assembly 114, defines an opening of the inlet end 110; while the last, or outlet rotor assembly 122, defines an opening of the outlet end 112.

Each of the rotor assemblies 114, 116, 118, 120, and 122 comprises a drum such as drum 124 of rotor assembly 118. While the rotor assemblies 114, 116, 118, 120, and 122 are generally similar in design to one another, the rotor assemblies 114, 116, 118, 120, and 122 can comprise varying shapes. The varying shapes of the rotor assemblies 114, 116, 118, 120, and 122 correspond to the shape of the prolate spheroid frame 108.

The drum 124 comprises a cylindrical drum frame or sidewall 126 that mounts to one or more of the struts 102, 104, and 106. A plurality of blades, such as blade 128, are disposed in a radial pattern within the drum 124. As mentioned above, in some embodiments, the plurality of blades are fixed within the drum 124.

In other embodiments, the plurality of blades can freely rotate within the drum 124. That is, the drum 124 provides rotatable support for the plurality of blades, allowing the plurality of blades to freely rotate similar to a turbine. In one embodiment, the plurality of blades can be associated with a drum surface, such as surface 130. The drum surface 130 can associate with (or be integral with) a race bearing 132 (see FIG. 2) or other similar cylindrical bearing that provides free rotation of the blades within the drum 124. According to various embodiments, the blades can rotate within the drum 124 as the football 100 spins or spirals while in flight. The spinning or spiraling of the football 100 can produce additional forward propulsion in the direction of travel of the football 100 as the blades in the football 100 rotate.

The blades can have unique geometrical configurations that include variances in cambering, twisting, angle of attack, and cross-sectional size along chord length—just to name a few. The blades each comprise a similar cambering and/or twisting that produce a right-handed effect or a left-handed effect. The radial arrangement of the blades within the drum 124 cause the blades of the rotor assemblies (such as rotor assembly 118) to rotate either clockwise or counterclockwise during flight, based on their right-handedness or left-handedness. This difference in right-handedness or left-handedness can either increase the distance the football 100 travels when thrown or can decrease the distance the football 100 travels when thrown. It may be advantageous to have the rotor assemblies increase the distance the football 100 travels, for example, when a child is throwing the football 100 and may not have sufficient upper body strength. Conversely, it may be advantageous to have the rotor assemblies decrease the distance the football 100 travels. For example, it may be desired to have the football 100 travel a shorter distance based on rotor assembly movement when a player desires to increase strength. The player will have to throw the football 100 harder to achieve the same travel distance when the player throws a similar football without the rotor assemblies. The rotor assemblies effectively increase resistance on the football 100 when thrown through the air.

Generally described, the rotor assemblies change at least one aerodynamic aspect of flight of the recreational device (e.g., the football) when air passes through the prolate spheroid frame and rotates (or is rotated by) the plurality of blades of the one or more rotor assemblies.

Figure 3:
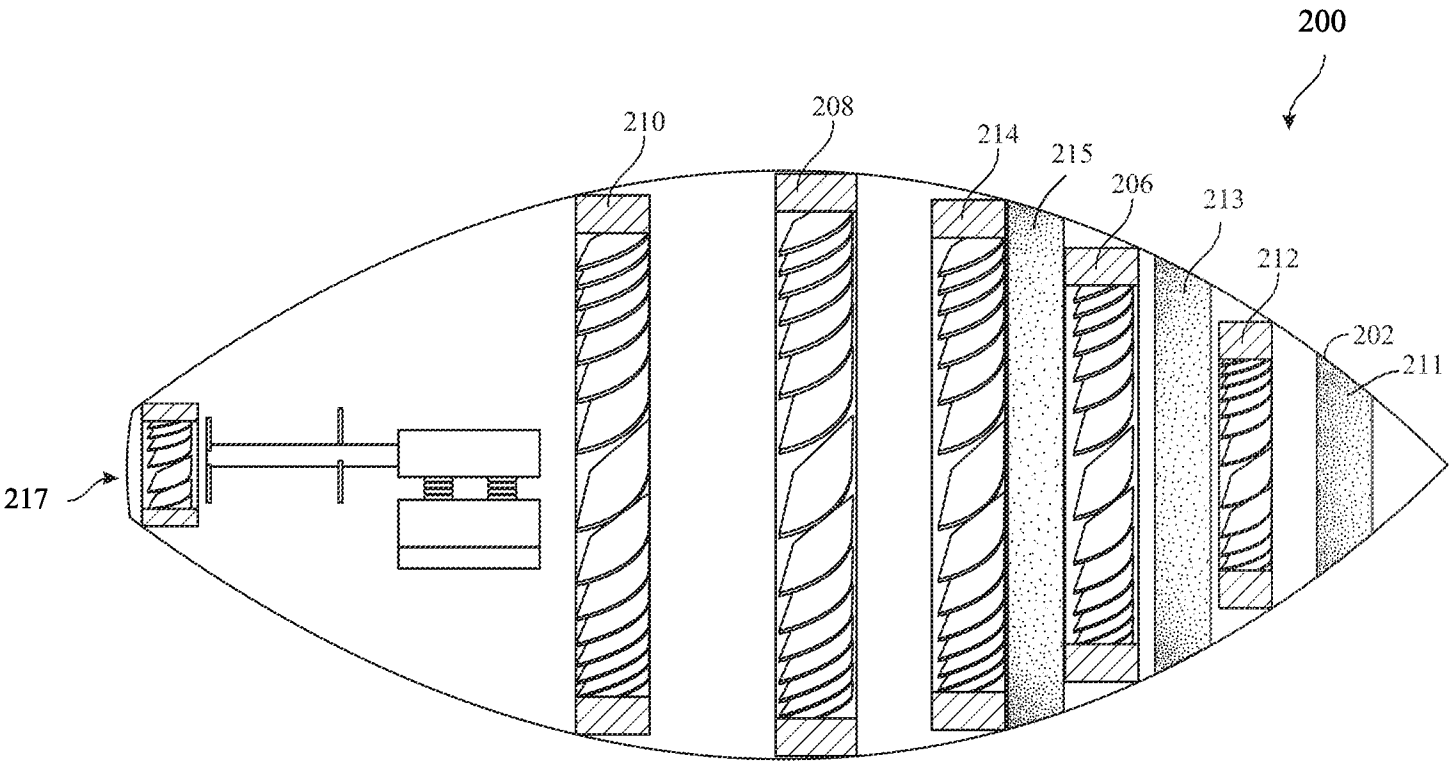
FIG. 3 is a side elevation, cross-sectional view of an example recreational device comprising a motor assembly.

The football 100 of FIG. 1 can be covered at least partially or entirely with a covering or skin, similarly to the embodiment of FIG. 3.

Figure 2:
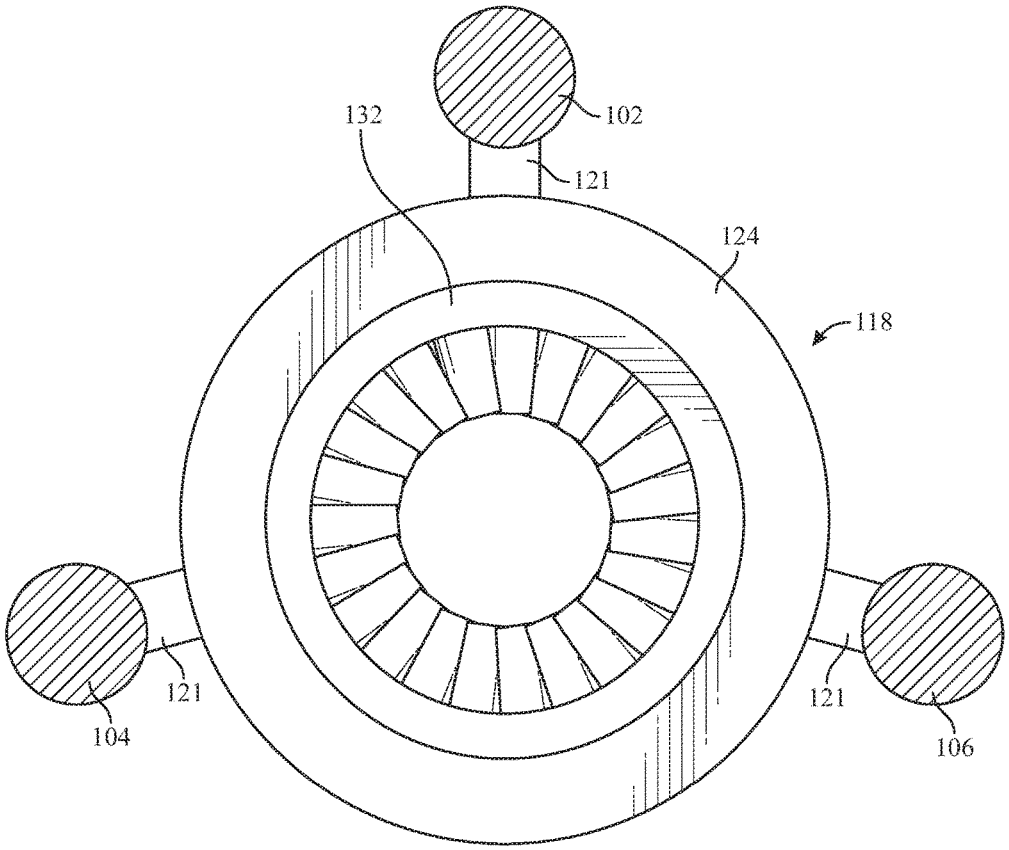
FIG. 2 is a cross-sectional view of an example recreational device illustrating a plurality of blades of a rotor assembly.

Referring now to FIG. 2, an example securement between the drum 124 and struts 102, 104, and 106 is illustrated. Again, this illustrates one of a possible plurality of drums of the rotor assemblies; for example, drum 124 of rotor assembly 118 is illustrated. A linkage, such as linkage 121, extends between each of struts 102, 104, and 106 and the drum 124.

FIG. 3 illustrates another example football 200 that comprises an outer covering or skin 202, rotor assemblies 206, 208, 210, 212, and 214 and a motor assembly 216. Additional or fewer rotor assemblies can be included. The skin 202 can comprise any suitable material used with recreational footballs or any other suitable material that would be known to one of ordinary skill in the art. In one embodiment, the skin 202 comprises air intake apertures 211, 213, and 215. These air intake apertures 211, 213, and 215 provide a pathway for air to enter football 200. In another embodiment, the air intake apertures 211, 213, and 215 can extend around a circumference of the football 200. The air intake apertures can be disposed forward of their respective rotor assemblies. For example, air intake aperture 211 is located forward of rotor assembly 212, air intake aperture 213 is located forward of rotor assembly 206, and air intake aperture 215 is located forward of rotor assembly 214. These air intake apertures 211, 213, and 215 can comprise large openings in the skin 202, perforated sections in the skin 202, or other means for allowing air into the football 200. Additional or fewer air intake apertures can be utilized. In some embodiments, an air intake aperture is provided for each rotor assembly.

The skin 202 also comprises an air outlet opening 217 at a rear end of the football 200 that allows air to exit the football 200. That is, air that is received through the air intake apertures (for example, air intake apertures 211, 213, and/or 215), which is passed over the rotor assemblies (for example, rotor assemblies 212, 206, and/or 214), exits through the air outlet opening 217.

Figure 4:
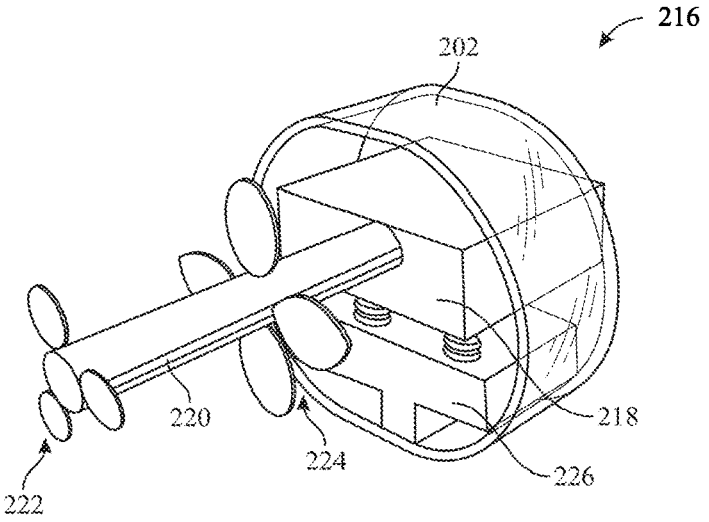
FIGS. 4 and 5 collectively illustrate an example motor assembly for use with embodiments of the present disclosure.
Figure 5:
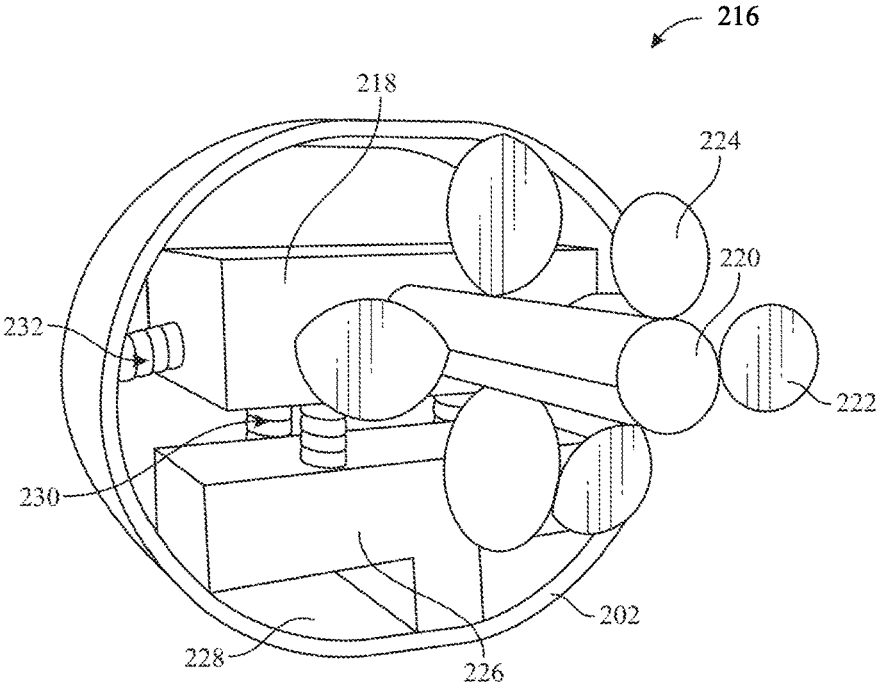

The motor assembly 210 is disposed rearwardly/downstream of the rotor assembly 208. In more detail, FIGS. 4 and 5 collectively illustrate the motor assembly 210. The motor assembly 210 comprises a motor 218, a shaft 220 rotatably coupled with the motor 218, and a plurality of propeller blades disposed on the shaft such as blade set 222 and blade set 224.

In one embodiment, the motor 218 is coupled with a t-shaped support 226. The support 226 is coupled to an inner sidewall 228 of the skin 202. A first set of vibrational dampers 230, such as springs, couples the motor 218 to the support 226, while a second set of vibrational dampers 232 extend between the motor 218 and the inner sidewall 228 of the skin 202.

When in flight, the motor 218 rotates the shaft 220 to spin the blade set 222 and the blade set 224, producing propulsion in the direction of travel of the football 200. Air propelled by the motor assembly 210, aided by the rotor assemblies 206 and 208, exits the air outlet opening 217 (see FIG. 3), propelling the football 200 forward. This configuration effectively reduces the throwing force required from a user.

Figure 6:
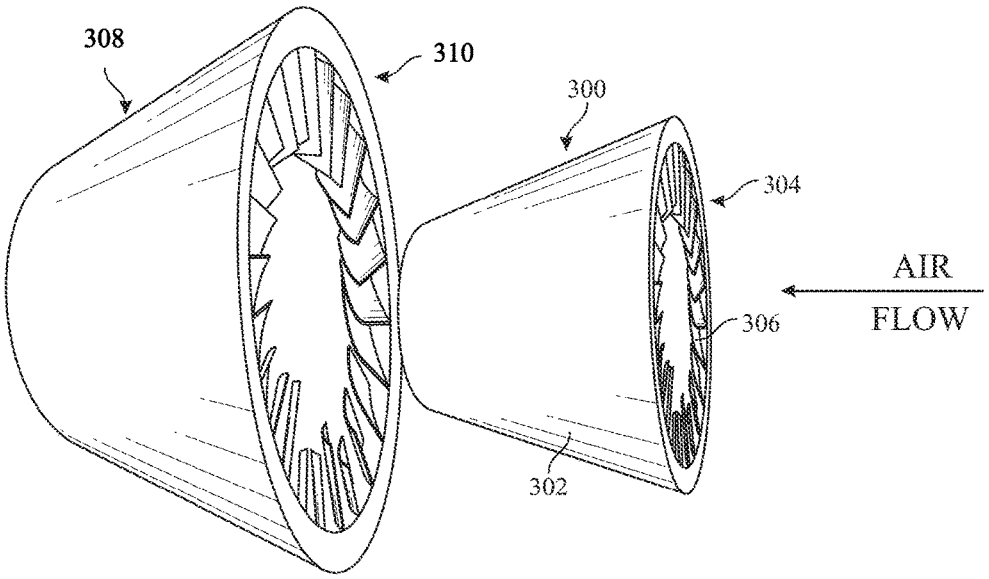
FIG. 6 is a perspective view of a pair of rotor assemblies having frusto-conical shapes.
Figure 7:
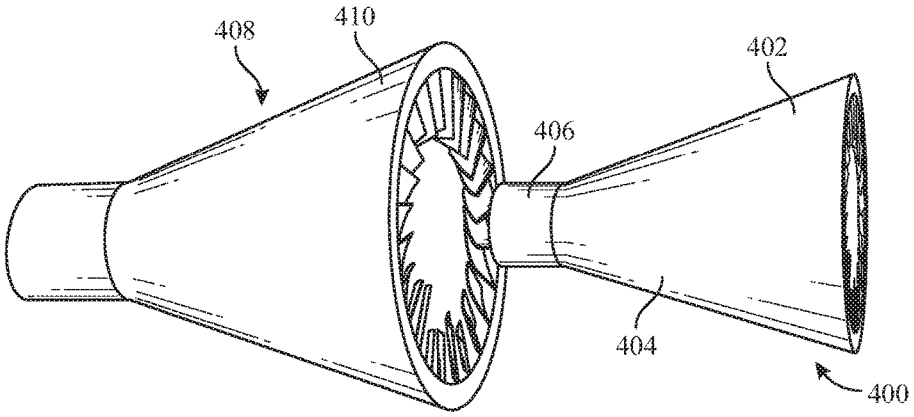
FIG. 7 is a perspective view of a pair of rotor assemblies having both a funnel and nozzle.
Figure 8:
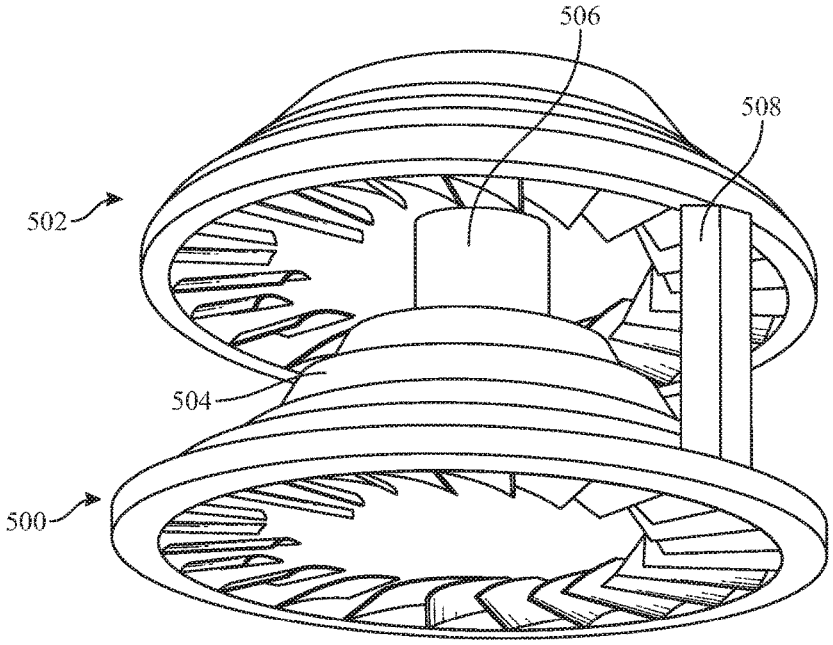
FIG. 8 is a perspective view of a pair of rotor assemblies having a funnel with a stair-stepped sidewall.

FIGS. 6-8 illustrate various embodiments of drums for use in the rotor assemblies of the recreational devices of the present disclosure. For example, FIG. 6 illustrates a recreational device that is identical to the recreational device of FIG. 3 with the exception that the rotor assemblies shown in FIG. 6, such as rotor assembly 300 comprise a drum 302 that is substantially frusto-conical (also referred to herein as frustoconical) in shape. When installed in a football of the present disclosure, a large open end 304 of the rotor assembly 300 functions as an inlet for receiving air. When air is passed through blades 306 of the rotor assembly 300, it exits a rear opening of the rotor assembly 300 and is directed into an inlet 310 of a downstream rotor assembly 308. Air also flows around an outer periphery of the rotor assembly 300 into the downstream rotor assembly 308 due to respective size differences. For example, the downstream rotor assembly 308 comprises a diameter that is greater than a diameter of the rotor assembly 300. This allows the rotor assembly 300 to fit proximate to a front of the football (again, the football has tapered ends because it is a prolate spheroid), while the downstream rotor assembly 308 is located closer to a middle of the football.

The use of frusto-conical shaped drums increases velocity of air passing through the rotor assemblies.

FIG. 7 illustrates a recreational device that is identical to the recreational device of FIG. 3 with the exception that the rotor assemblies shown in FIG. 7 include a rotor assembly 400 comprising a drum 402 having a funnel portion 404 and a nozzle portion 406. A second, downstream rotor assembly 408 receives air from the nozzle portion 406, as well as air flowing around an outer periphery of the funnel portion 404. The rotor assembly 400 and rotor assembly 408 are configured to be placed in series when disposed within a football. The wide open ends of the rotor assemblies 400 and 408 are inlets that receive airflow (note that air can enter the football and into the rotor assemblies 400 and 408 through air inlet apertures described above).

When installed in a football of the present disclosure, the funnel portion 404 of the rotor assembly 400 functions as an inlet for receiving air. When air is passed through blades of the rotor assembly 400, it exits the nozzle portion 406 of the rotor assembly 400 and is directed into the funnel portion 410 of a downstream rotor assembly 408. As illustrated, the downstream rotor assembly 408 comprises a diameter that is greater than a diameter of the rotor assembly 400. This allows the rotor assembly 400 to fit proximate to a front of the football (again, the football has tapered ends because it is a prolate spheroid), while the downstream rotor assembly 408 is located closer to a middle of the football.

FIG. 8 illustrates a recreational device that is identical to the recreational device of FIG. 3 with the exception that the rotor assemblies shown in FIG. 8 include another example pair of rotor assemblies 500 and 502. The rotor assembly 500 and rotor assembly 502 each comprise a sidewall 504 that is stairstepped. Rotor assembly 500 terminates with a nozzle 506. The rotor assembly 502 is located downstream of the rotor assembly 500 and receives air from the nozzle 506.

In some embodiments, the rotor assemblies 500 and 502 are coupled together with a support strut 508. In other embodiments, the rotor assemblies 500 and 502 are coupled together with more than one support strut 508. The support strut 508 can provide more structural support and stability (for example, by minimizing oscillation) within the recreational device, according to various embodiments.

Figure 9:
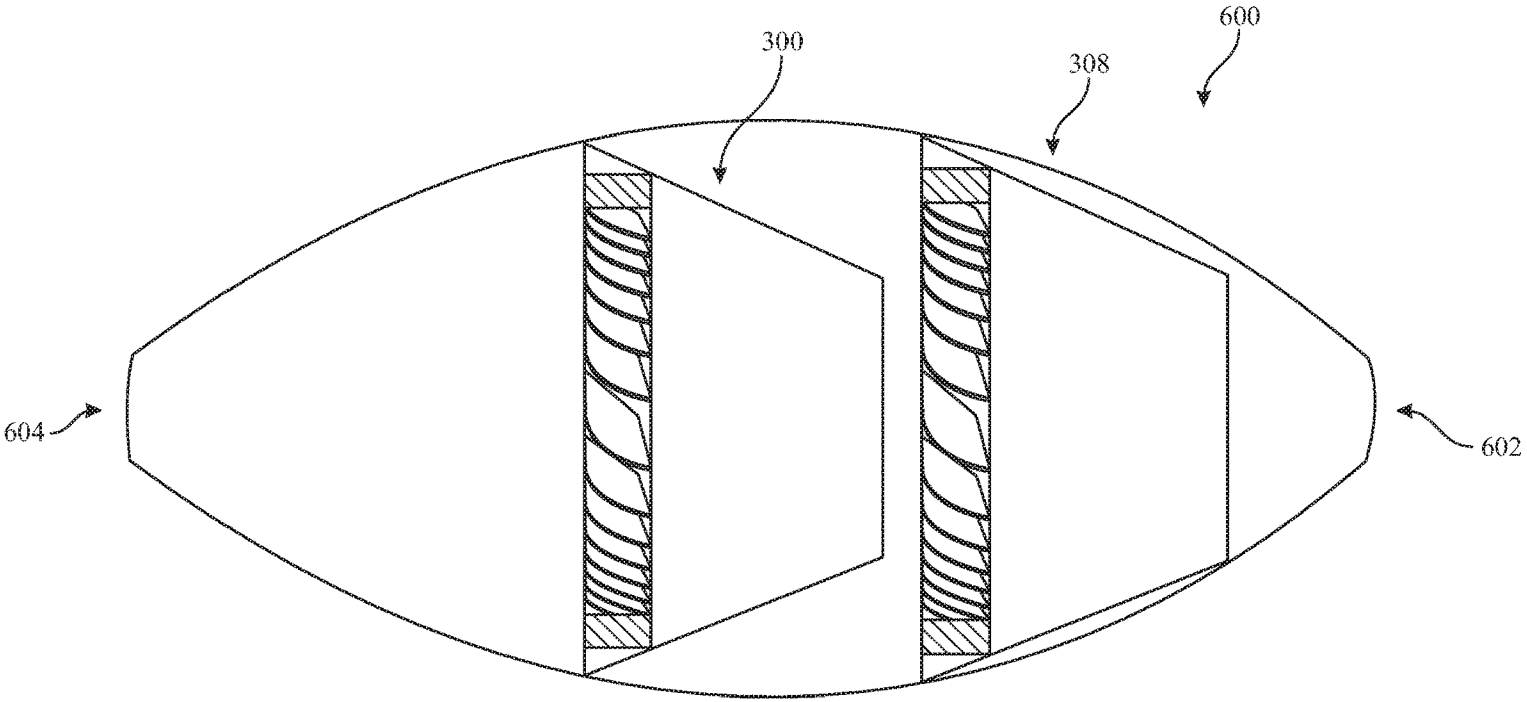
FIG. 9 is a cross-section of an exemplary football comprising the rotor assemblies of FIG. 6.

FIG. 9 is a cross-section of another example football 600 that comprises the rotor assemblies 300 and 308 of FIG. 6. Additionally, the football 600 comprises a skin that includes a first opening 604 and a second opening 602. When the football 600 is thrown, air enters the first opening 604 causing the rotor assembly 300 to spin. Due to the shape (e.g., conical shape) of the rotor assembly 300, higher velocity air is injected into the rotor assembly 308. The combined rotation of the rotor assemblies 300 and 308 changes the flight behavior of the football 600 compared to similar devices with no rotors.

Figure 10:
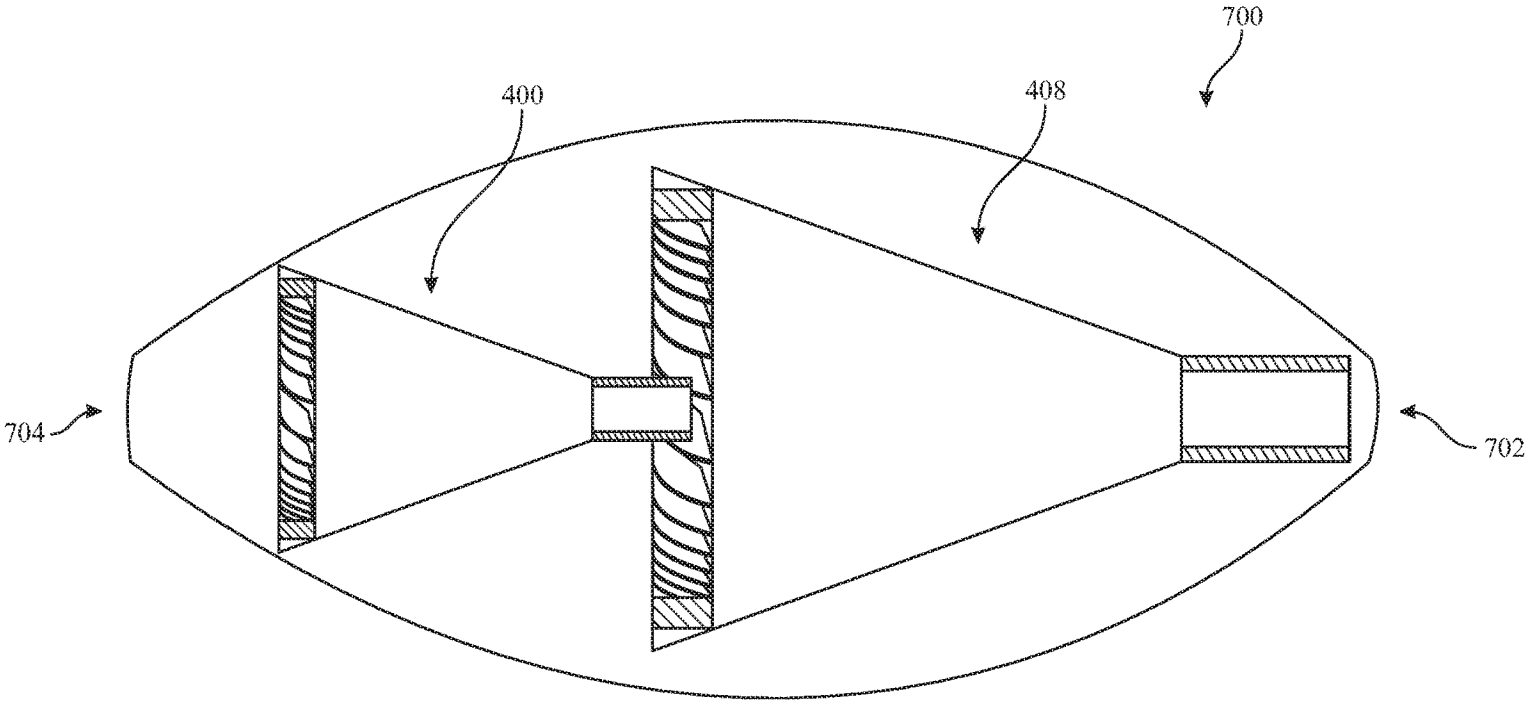
FIG. 10 is a cross-section of an exemplary football comprising the rotor assemblies of FIG. 7.

FIG. 10 is a cross-section of another example football 700 that comprises the rotor assemblies 400 and 408 of FIG. 7. Additionally, the football 700 comprises a skin that includes a first opening 704 and a second opening 702. When the football 700 is thrown, air enters the first opening 704 causing the rotor assembly 400 to spin. Due to the shape (e.g., funnel shape) of the rotor assembly 400, higher velocity air is injected into the rotor assembly 408. The combined rotation of the rotor assemblies 400 and 408 changes the flight behavior of the football 700 compared to similar devices with no rotors. In some embodiments, a nozzle of the rotor assembly 400 can nest inside the rotor assembly 408. In other embodiments, the rotor assemblies 400 and 408 can be spaced apart from one another (e.g., not nested).

While this technology is susceptible of embodiment in many different forms, there is shown in the drawings and has been described in detail several specific embodiments with the understanding that the present disclosure is to be considered as an exemplification of the principles of the technology and is not intended to limit the technology to the embodiments illustrated.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A recreational device, comprising:

a plurality of struts forming a prolate spheroid frame; and two or more rotor assemblies each having a plurality of blades, the two or more rotor assemblies being disposed within the prolate spheroid frame, the two or more rotor assemblies changing at least one aerodynamic aspect of flight of the recreational device when air passes through the prolate spheroid frame and across the plurality of blades of the two or more rotor assemblies as the recreational device spirals during flight, each of the two or more rotor assemblies comprising a drum, the plurality of blades of the two or more rotor assemblies arranged into a radial pattern within each of the drums, the plurality of blades of the two or more rotor assemblies freely rotating within each of the drums.

2. The recreational device according to claim 1, wherein a first of the two or more rotor assemblies is disposed at an open inlet end of the prolate spheroid frame.

3. The recreational device according to claim 2, wherein a last of the two or more rotor assemblies is disposed at an open outlet end of the prolate spheroid frame.

4. The recreational device according to claim 1, wherein each of the drums is secured to the plurality of struts.

5. The recreational device according to claim 1, wherein the prolate spheroid frame is covered with a skin.

6. The recreational device according to claim 5, wherein the skin comprises air intake apertures that allow the air to enter the prolate spheroid frame.

7. The recreational device according to claim 6, wherein the air intake apertures are located forward of the two or more rotor assemblies to allow the air to enter the prolate spheroid frame and rotate the plurality of blades of the two or more rotor assemblies.

8. The recreational device according to claim 1, further comprising a motor assembly that comprises:

a motor;

a shaft rotatably coupled with the motor, the motor rotating the shaft; and a plurality of propeller blades disposed on the shaft.

9. The recreational device according to claim 8, wherein the motor assembly further comprises a support coupled to an inner sidewall of a skin that surrounds the plurality of struts, wherein the motor is coupled to the support by a first set of vibrational dampers.

10. The recreational device according to claim 9, further comprising a second set of vibrational dampers extending between the motor and the inner sidewall of the skin.

11. The recreational device according to claim 1, wherein the drum of each of the two or more rotor assemblies couples with the prolate spheroid frame, further wherein each of the drums is a funnel with a frustoconical shape.

12. The recreational device according to claim 1, wherein the drum of each of the two or more rotor assemblies couples with the prolate spheroid frame, further wherein each of the drums is a funnel comprising a nozzle, the nozzle directing the air into a downstream one of the two or more rotor assemblies.

13. The recreational device according to claim 1, wherein the drum of each of the two or more rotor assemblies couples with the prolate spheroid frame, further wherein each of the drums is a funnel having a stairstep sidewall.

14. The recreational device according to claim 12, wherein adjacent ones of the two or more rotor assemblies are coupled together with one or more support struts.

15. A football, comprising:

a plurality of struts forming a frame, the frame having open ends that allow air to pass into and out of the frame through the open ends; and two or more rotor assemblies each having:

a drum; and a plurality of blades that are rotatably supported within each of the drums, the two or more rotor assemblies being disposed within the frame, the plurality of blades of the two or more rotor assemblies rotating when the football is thrown through the air.

16. The football according to claim 15, further comprising a motor assembly that comprises:

a motor;

a shaft rotatably coupled with the motor, the motor rotating the shaft; and a plurality of propeller blades disposed on the shaft, the motor rotating the plurality of propeller blades to provide additional propulsion to the football during flight.

17. The football according to claim 16, further comprising a skin that covers the frame, wherein the skin comprises air intake apertures that allow the air to enter the frame.

18. The football according to claim 17, wherein the air intake apertures are located forward of the two or more rotor assemblies to allow the air to enter the frame and rotate the plurality of blades of the two or more rotor assemblies.

19. A recreational device, comprising:

a plurality of struts forming a prolate spheroid frame having at least one open end;

two or more rotor assemblies each having a plurality of radially arranged blades; and means for rotatably supporting the plurality of radially arranged blades within the prolate spheroid frame in such a way that the plurality of radially arranged blades freely rotate within the prolate spheroid frame.

20. A recreational device, comprising:

a plurality of struts forming a prolate spheroid frame; and two or more rotor assemblies each having a plurality of blades, the two or more rotor assemblies being disposed within the prolate spheroid frame, the two or more rotor assemblies changing at least one aerodynamic aspect of flight of the recreational device when air passes through the prolate spheroid frame and across the plurality of blades of the two or more rotor assemblies as the recreational device spirals during flight, the two or more rotor assemblies each comprises a drum that couples with the prolate spheroid frame, further wherein each of the drums is a funnel with a frustoconical shape.

21. A recreational device, comprising:

a plurality of struts forming a prolate spheroid frame; and two or more rotor assemblies each having a plurality of blades, the two or more rotor assemblies being disposed within the prolate spheroid frame, the two or more rotor assemblies changing at least one aerodynamic aspect of flight of the recreational device when air passes through the prolate spheroid frame and across the plurality of blades of the two or more rotor assemblies as the recreational device spirals during flight, the two or more rotor assemblies each comprises a drum that couples with the prolate spheroid frame, each of the drums is a funnel comprising a nozzle, the nozzle directing the air into a downstream one of the two or more rotor assemblies.

22. A recreational device, comprising:

a plurality of struts forming a prolate spheroid frame; and two or more rotor assemblies each having a plurality of blades, the two or more rotor assemblies being disposed within the prolate spheroid frame, the two or more rotor assemblies changing at least one aerodynamic aspect of flight of the recreational device when air passes through the prolate spheroid frame and across the plurality of blades of the two or more rotor assemblies as the recreational device spirals during flight, the two or more rotor assemblies each comprises a drum that couples with the prolate spheroid frame, each of the drums is a funnel having a stairstep sidewall.

* * * * *